US006270597B1

(12) United States Patent
Van den Sype

(10) Patent No.: US 6,270,597 B1
(45) Date of Patent: Aug. 7, 2001

(54) PROCESS FOR CONTINUOUS HEATING AND CLEANING OF WIRE AND STRIP PRODUCTS IN A STRATIFIED FLUIDIZED BED

(75) Inventor: Jaak Stefaan Van den Sype, Katonah, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/212,388

(22) Filed: Dec. 16, 1998

(51) Int. Cl.[7] ..... C21D 9/52; C21D 1/53; C21D 1/06

(52) U.S. Cl. ..... 148/596; 148/595; 148/630; 148/657; 266/249; 266/251; 266/253

(58) Field of Search ..... 148/596, 595, 148/630, 657; 266/103, 251, 249, 253

(56) References Cited

U.S. PATENT DOCUMENTS 3,053,704 * 9/1962 Munday ..... 148/20.3
4,013,279 * 3/1977 Virr ..... 266/249
4,340,433 * 7/1982 Harding ..... 148/16
4,813,653 * 3/1989 Piepers ..... 266/251
5,049,408 * 9/1991 Klinedinst et al. ..... 427/69
5,225,005 * 7/1993 Burrage et al. ..... 148/108
5,441,581 * 8/1995 Van den Sype et al. ..... 148/634

OTHER PUBLICATIONS

J.A. Virta, "Use of Atmospheres in Fluidized Bed Heat Treatments", Heat Treatment '84, Proceedings of the International Conference organized by the Heat Treatment Committee of the Metals Society, London, Ch. 15, May 2–4, 1984.

"Fluidized Bed Heat Treatment Systems", Technical Report, Wire Association International, Inc., 1983.

* cited by examiner

*Primary Examiner*—Roy King
*Assistant Examiner*—Harry D. Wilkins, III
(74) *Attorney, Agent, or Firm*—Bernard Lau

(57) ABSTRACT

This invention is directed to a method for annealing strand wires or strips in a fluidized bed reactor having an atmosphere of fluidized gases flowing through fluidized particles. The method provides for stratifying the atmosphere of fluidized gases by passing a reducing gas through the fluidized particles in the fluidized bed. The wires are passed between the fluidized particles at a location near the bottom of the fluidized bed. Finally, an amount of oxygen-containing gas is injected on top of said fluidized bed reactor.

19 Claims, 2 Drawing Sheets

PROCESS FOR CONTINUOUS HEATING AND CLEANING OF WIRE AND STRIP PRODUCTS IN A STRATIFIED FLUIDIZED BED

FIELD OF THE INVENTION

This invention is generally related to a method for producing wires, wire rods, sheets and strips. More specifically, this invention relates to an intermediate step in the producing process by strand heating a wire, wire rod, sheet or strip in a stratified fluidized bed to produce a product having a clean, oxide-free and decarb-free surface.

BACKGROUND OF THE INVENTION

Strand heating of wire, wire rod, sheet or strip (hereinafter collectively "wire and strip") is an operation commonly performed as an intermediate step prior to other treatments such as oxide coating, galvanizing, quenching or further drawing or rolling. These subsequent operations are often performed in line with strand heating. Processes such as oxide coating, galvanizing and subsequent drawing or rolling require that the surface of the wire be clean so that coatings such as oxide, zinc and lubricant will adhere to the steel wire or strip.

Wire or Wire Rod Processing

For high carbon wire, it is also important that the strand does not decarburize the wire. In most existing strand heating processes, the exiting wire is dirty and has an oxidized surface, thus requiring in-line pickling prior to further processing. Because the costs attributed to the pickling process have risen substantially due to environmental considerations, an economical process for strand annealing with a clean, oxide-free and decarb-free surface is desired.

There are currently a number of methods for annealing wires. However, all of the current methods for annealing wires contain certain disadvantages.

Generally, the present state of the art provides for the strand annealing of wires or wire rods either with or without the subsequent requirement for in-line pickling.

Strand annealing with in-line lead bath is the traditional strand annealing process that is still currently in wide practice. The heating rate is very fast and good temperature uniformity is achieved at high production rates. As a result, this particular process is economical. The drawback in this process, however, is the need to avoid excessive lead typically being dragged out from the bath. The wire surface must not be wetted by the molten lead, and the wire surface must be kept in a dirty state (containing oxide and lubricant residues). The drawback to the use of this process is the need to clean the wire, usually by an in-line pickling process, prior to undergoing further processing. Because of the problems with lead contamination, this process poses a necessary but environmentally unfriendly procedure to prevent any such contamination, which increases the expenses necessary for the strand annealing process.

Another process for strand annealing which requires in-line pickling is strand annealing in fluidized beds. In this process, continuous fluid bed lines were developed for annealing strand wires. The beds are fluidized and heated using products of combustion, typically with natural gas and air. The heating rates are substantially lower than lead baths, so the bed lengths are greater and production rates are lower. It is possible to achieve higher production rates by preheating the wire via induction heating of up to about 1300° F. Since the atmosphere in the fluidized bed contains the products of combustion (i.e., nitrogen, carbon dioxide and water), the wires will be oxidized and the surface will be decarburized. As a result, in-line pickling is required before further processing is performed in this process.

A variety of processes for producing clean wires that do not require in-line pickling are also known in the art. One such process is strand annealing in multi-tube furnaces. In this process, the wires are heated in individual tubes, typically in a pure hydrogen atmosphere. Up to sixteen tubes, each containing a wire, are mounted in a large furnace. Even in the pure hydrogen atmosphere, the production rates are slow due to the poor heat transfer between gas and metal. The tube length can not be made much longer than about 40 feet due to excessive drag on the wire. This process produces bright (oxide-free) wires and the wires do not require in-line pickling prior to further processing. This method, however, is not economical for large-scale production.

Yet another process for producing clean wires without in-line pickling is heating the fluidized bed indirectly by inserting a set of firing tubes in the bed. The bed is fluidized with an inert gas like nitrogen. This process produces bright, decarb-free wire. This process is disadvantageous because it requires a large amount of nitrogen, making the process uneconomical, even when the nitrogen is recycled.

Therefore, it is an object of the present invention to provide for a process for strand annealing wires that does not require pickling prior to further processing. Additionally, it is an object of this invention to provide a wire strand annealing process that does not require a large amount of either nitrogen or hydrogen such that the process becomes uneconomical.

Sheet or Strip Processing

Steel sheet and strip are usually produced by hot rolling from slabs in continuous hot-strip mills. For the low-carbon steels generally used for sheet and strip, the finishing temperature at the last rolling stand is generally about 1550° F. Since the rolling mills operate in air, the steel sheet or strip undergoes oxidation. The presence of an oxide scale on the sheet or strip is objectionable if the sheet or strip is to be processed further. For example, if the sheet is for drawing applications, removal of the oxide is essential since its presence results in short die life and poor surface finish on the finished product. Oxide removal is also essential if further processing involves any type of coating such as metallic coatings (e.g. zinc) or non-metallic coatings (e.g. paint).

A common method of cleaning the sheet or strip after hot rolling is by passing through the continuous pickling lines. In these pickling lines, the steel sheet or strip passes through a series of baths based on either sulfuric acid or hydrochloric acid. The environmental disadvantages associated with acid pickling lines are well known and high capital expense is incurred for the treatment of waste pickle liquors and prevention of corrosion of equipment and buildings. Another method known in the art for removing scale from sheet or strip is by continuously blasting the sheet or strip with abrasive grit or steel shot, thereby mechanically removing the scale. While these shot-blasting methods avoid the problems of waste pickle-liquor disposal, the process is inherently slow and therefore uneconomical.

It is an object of this invention to provide a method for removing scale from steel sheet or strip products in an environmental friendly manner and operating at temperatures at or above 1200° F.

SUMMARY OF THE INVENTION

One aspect of this invention is directed to a method for strand heating of wires or strips in a fluidized bed reactor having an atmosphere of gases containing a high hydrogen content that flows through fluidized particles comprising a) stratifying the atmosphere by passing a reducing gas through the fluidized particles in the fluidized bed; b) passing the wires or strip between the fluidized particles at a location near the bottom of the fluidized bed; and c) injecting an amount of oxygen-containing gas on top of said fluidized bed reactor.

Another aspect of the this invention is directed to a method for annealing wire, sheet or strip in a fluidized bed reactor having an atmosphere of fluidizing gases containing a high hydrogen gas content, the fluidizing gases flowing through fluidizing particles comprising a) passing an effective amount of a reducing gas through the fluidizing particles in the fluidized bed to separate an elutriated fraction of the fluidizing particles out of the fluidized bed; b) passing a portion of a wire, sheet or strip vertically through the fluidized bed; c) injecting an amount of oxygen-containing gas through the top of the fluidized bed reactor; and d) separating the elutriated fraction of fluidizing particles from the reducing gases and returning the elutriated fraction of fluidizing particles back to the bottom of the bed.

BRIEF DESCRIPTION OF THE DRAWINGS

Other objects, features and advantages will occur o those skilled in the art from the following description of preferred embodiments and the accompanying drawings, in which.

DETAILED DESCRIPTION OF THE INVENTION

This invention is for strand heating of wires and strips wherein the resulting products are clean and oxide-free. Essentially, this invention provides for the combination of a few key concepts. For the horizontal reactor layout of FIG. 1, the strand wires should pass through the reactor within about one-foot above the fluidizing plenum. The bed is fluidized using a fluidizing gas preferably produced by four types of reactions:

1) the partial oxidation of natural gas (hereinafter called "DI" gas); other hydrocarbons can be used and the oxidant can range from air (about 19% oxygen) to 100% oxygen, for natural gas the hydrogen content of the fluidizing DI gas will therefore range from 40% (air) to 66% (100% oxygen);
2) steam reforming of natural gas or other hydrocarbons; for natural gas the fluidizing gas will contain about 75% hydrogen with the balance being carbon monoxide;
3) steam reforming combined with shifting reactions; for natural gas the fluidizing gas will contain 80% hydrogen with the balance being carbon dioxide (reformate gas); or
4) a synthetic mixture of a) hydrogen or b) nitrogen combined with hydrogen, the mixture having a hydrogen content of at least about 50%.

These gases are all reducing to steel and will produce wire with a clean and decarb-free surface. The Btu content of the fluidizing gas is at least about 100 Btu/MCF and the flow rate of the fluidizing gas is between 2 and 5 times the minimum fluidizing flow. Oxygen-containing gas, including air, is then injected through an air sparger situated in the top part of the bed for combusting the fluidizing gas. The distance between the wires and the air sparger is at least about one foot, and preferably two feet. Generally, this distance between the wires and the sparger is expected to prevent combustion products (carbon dioxide and steam) from diffusing to the wire environment where they would lead to oxidation. The air spargers are immersed in the bed to a depth of about one to two feet so that combustion of the upflowing fluidizing gas heats the bed particles. The total bed height above the fluidizing plenum is about three to five feet.

Figure 1:
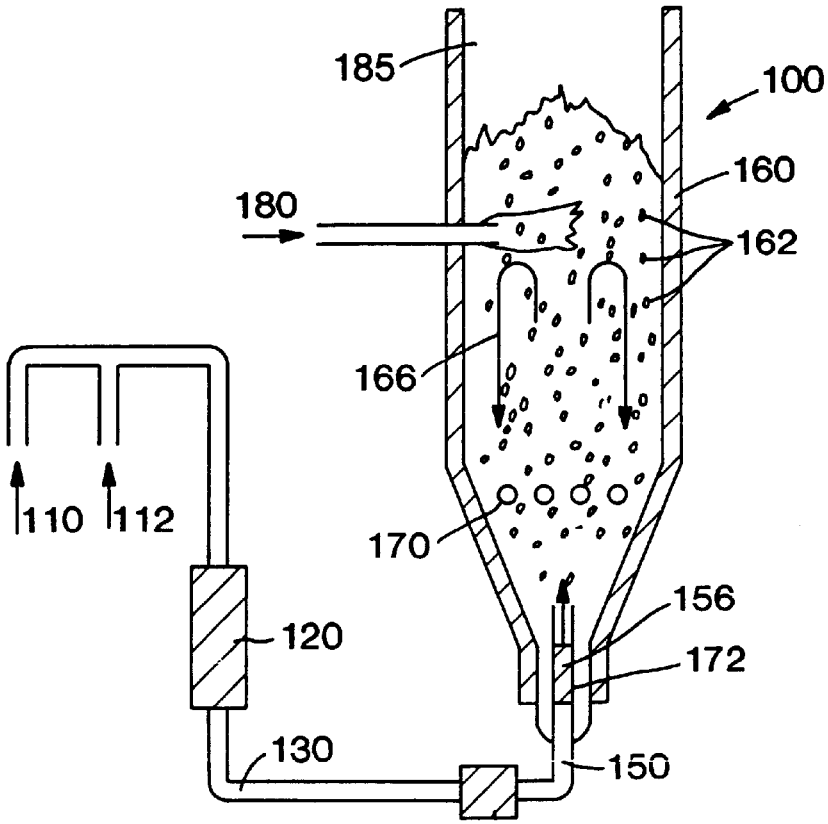
FIG. 1 provides the general layout of the fluid bed reactor wherein the product passes horizontally through the reactor. This is the preferred embodiment for the treatment of wires.

FIG. 1 provides the general layout of the process of the preferred embodiment for wires. An oxygen-containing containing gas 112 (such as air) and fuel 110 (such as natural gas) are provided in a ratio of moles of oxygen in the oxidant to moles of carbon in the hydrocarbon of 1:2. With air as oxidant and natural gas as hydrocarbon this ratio is about 2.4:1. In practice for the air/natural gas mix the ratio can vary from about 1.8:1 to about 3:1. The mixture is preheated to a temperature of greater than 750° F., but no higher than 1100° F. in a heat exchanger which forms an integral part of the partial oxidation (POX) reactor 120 forming DI gas 130. The DI gas is formed in the POX reactor by passing the preheated oxygen-containing gas-fuel mixture over a noble metal catalyst, preferably platinum on alumina where it reacts to form DI gas 130 or the fluidizing gas. As used in this invention, no external heat source is required.

The other methods for providing fluidizing gas suitable for the invention such as steam reforming or synthetic hydrogen/nitrogen mixtures are known in the art.

The fluidizing gas may be introduced to the bottom of a fluid bed through a diffuser manifold 156 onto the reactor 160. The manifold consists of a perforated metal plate, a piping system with perforations or porous ceramic tiles.

The fluidized particles 162 are known in the art and may be chosen from a number of inert oxide particles known in the art. Preferably, the fluidized particle is alumina.

The size range of the fluidizing particles 162 can vary from between about 74 to about 463 micron (Tyler mesh about 200 to about 37). For higher temperature operations, as typically used in steel wire annealing, such as the operation taking place between about 1500° F. to about 1800° F., the preferred size of the fluidizing particles ranges from about 175 to about 295 micron (Tyler mesh 80 to 48).

Typically, the number of wires 170 running in parallel through a strand annealing line is from between 12 to about 20. A particularly unique feature of the present invention involves running the strand annealing line containing the wires near the bottom of the fluidized bed. Preferably, the annealing line, which contains the wires, is placed within one foot above the diffuser plenum 172 or bottom of the fluidized bed.

The oxygen-containing gas 180 is injected from the upper portion of the fluidized bed and passes through the fluidized particle in reactor 160. Freeboard 185 is placed on top of the reactor 160.

The temperatures of the DI gas, which is used to fluidize the fluidizing particles in the reactor, may be relatively low (such as from about 600° F. to about 800° F.) as compared to the operating temperature of the bed (such as from about 1700° F. to about 1900° F.). Generally, the fluidizing gas will attain the bed temperature within one foot above the diffuser plenum 172 (or bottom of the reactor). As a result, the wire strands should be located at least one foot above the diffusing plenum 172.

The strand wires are passed through the reactor at a low position. A preferred method for passing the wires through the bed is through openings on the sides of the bed. On the exit end, the moving wire will drag the fluidizing particles (i.e., alumina) which form a defluidized dam. The fluidizing particles that are dragged out by the wires can be returned to the fluidized bed. The fluidized particles continuously circulate in the reactor 160 with the flow pattern 166.

The incoming wires are not required to be at room temperature before coming into the fluidized bed. In order to speed up the rate of production, the wires can be preheated via induction heating. Induction heating is generally only efficient up to about 1350° F. and occurs at the surface only. The fluidized bed then heats the wire up to the annealing temperature (e.g., 1800° F.) and equalizes the temperature throughout the wire cross section. In this way, the production rates equal to the lead bath annealing can be achieved.

Figure 2:
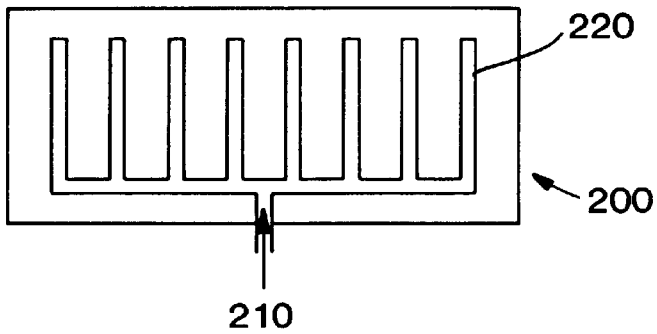
FIG. 2 is a top view of the fluidized bed of FIG. 1 with the air sparger.

FIG. 2 provides for a top view of fluidized bed with the air sparger. Oxygen-containing gas 210 is fed into sparger having certain horizontal slits 220. One preferred dimension provides for 0.125" w×2" l on 3" centers.

Figure 3:
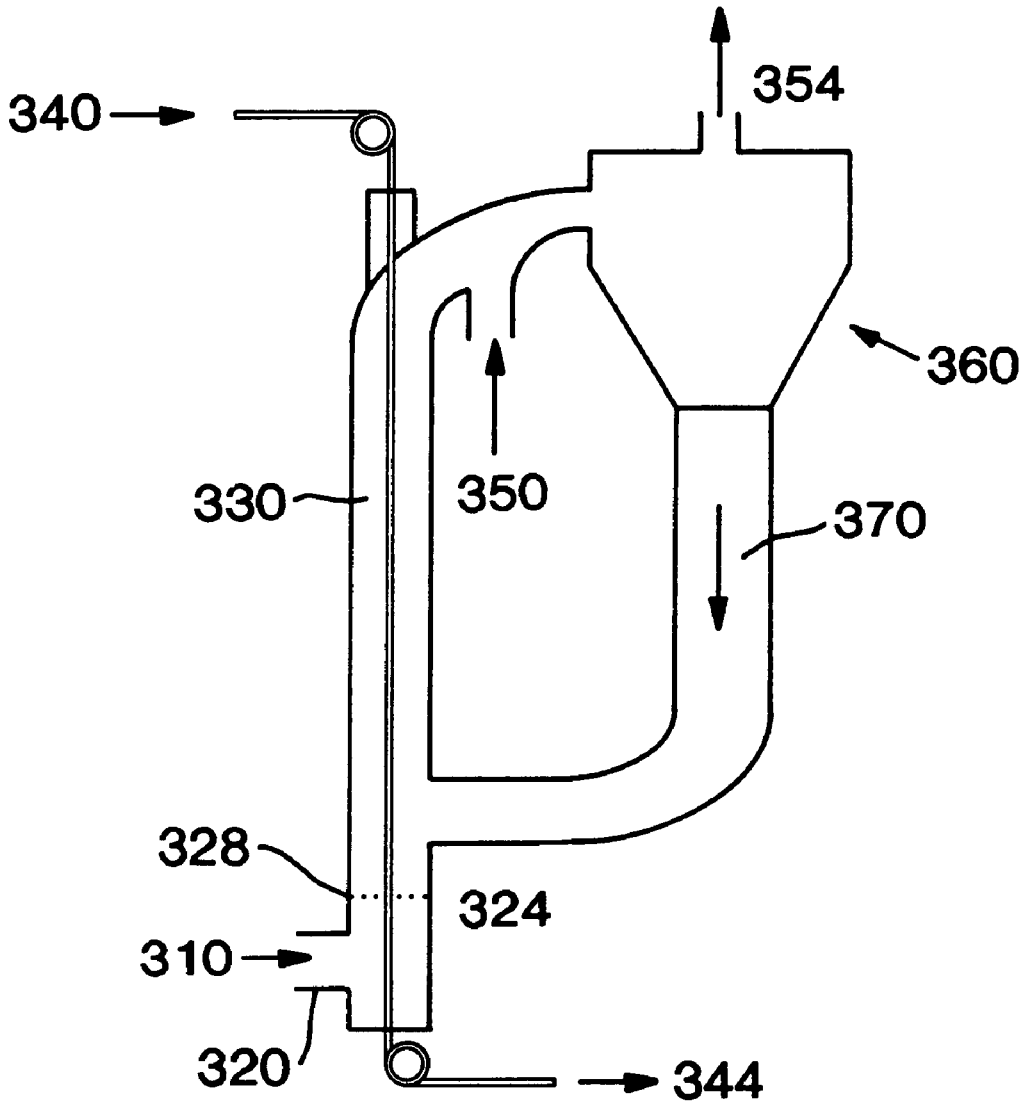
FIG. 3 provides the general layout of the fluid bed reactor wherein the product passes vertically through the reactor. This is the preferred embodiment for the treatment of sheet or strip.

For the production of clean oxide-free sheet and strip, the horizontal layout of the fluidizing bed reactor of FIG. 1 is not convenient because if the sheet or strip is moving horizontally through the bed, the fluidizing particles will defluidize above the strip, resulting in poor fluidization. A vertical fluid bed reactor as shown in FIG. 3 is the preferred embodiment for sheet and strip. Since in this arrangement, the product is moving vertically through the fluidized bed, the atmosphere cannot be stratified as is the case for the horizontal fluid bed reactor.

For the vertical fluid bed reactor, the fluidizing gas flow is increased so that a fraction of the particles are continuously carried out of the bed (spouting bed); the particles that are carried out are heated by injecting an oxygen-containing gas into the transfer duct thereby combusting the fluidizing gas. The heated particles are then returned to the bottom of the fluidized bed. Referring to FIG. 3, the high hydrogen-containing atmosphere prepared by any of the previously described methods such as DI or high hydrogen content gas 310 is introduced via conduit 320 to the bottom of the bed through a diffuser manifold 324. Again, this manifold can consist of a perforated metal plate, a piping system with perforations or porous ceramic tiles. The fluidized particles 330 are preferably alumina with a size range between about 70 and about 465 micron (Tyler mesh 200 to 37). The fluidized particles move upward and are carried out of the bed near its top section. Sheet or strip 340 is introduced at the top of the bed and moves continuously downward countercurrent to the flow of fluidizing gas and particles. The high hydrogen content of the fluidizing gas effectively reduces the oxides from the surface of the sheet or strip and clean strip 344 is taken out at the bottom of the bed. For effective oxide reduction the minimum temperature of the fluidized bed reactor is about 1200° F., but is preferably between 1500° F. and 1700° F. In the exit ductwork on top of the bed air or other oxygen-containing gas is introduced at inlet 350 in order to combust the fluidizing gas and heat the fluidizing particles to the desired temperature. The combustion gases and particles are exhausted at outlet 354 and the heated particles 370 are returned from separator 360, such as a cyclone separator, to the bottom of the bed at a location above the distributor plate 328.

It is found that the combined action of the high hydrogen atmosphere and the fluid bed particles rapidly heat the strip, reduce the oxides and clean the surface.

In order to lower the capital costs and/or increase the productivity, it is important to maximize the heat transfer rate between the wires or strip and the fluid bed. The parameters that maximize the heat transfer rates in fluid beds are provided as follows.

With reference to the thermal conductivity of the fluidizing gas, higher gas conductivities generally give higher heat transfer rates. Hydrogen has the highest conductivity, and therefore, the atmospheres with high hydrogen content are generally preferred.

The size of the fluidizing particles determines the heat transfer rate. Accordingly, the size of the fluidizing particles must be larger than the critical size for bubbly phase fluidization. At high temperature, a small particle size may lead to excessive dusting of the fluidized bed. For purposes of this invention, the preferred range of the fluidizing particle size for high temperature operation ranges from about 70 to about 465 micron (Tyler mesh 200 to 37), and preferably from about 175 to about 295 micron (Tyler mesh 80 to 48).

The gas flow rate is an important parameter in the rate of annealing the strand wire and strips. There is a minimum flow rate required to fluidize the bed of fluidizing particles, and significant increases in heat transfer rates are observed for larger flow rates.

Generally, the heat transfer coefficient increases and reaches a maximum at flow rates between three and fifteen times the minimum fluidizing flow ("MFF"). For the high hydrogen atmospheres of this invention, the maximum heat transfer is found to be between about 10 to about 15 times the MFF. Beyond the maximum, the heat transfer rate gradually decreases due to the increased fraction of void volume in the bed. In the present invention, the flow rate of the fluidizing gas used is also determined by the heating requirements of the fluidized bed since the fluidizing gas is used both as a reducing atmosphere for the wires and as fuel to heat the bed. Detailed calculations show that the preferred range of fluidizing flows is between about 2 and about 5 times the MFF for the horizontal fluidized bed reactor and between about 10 and about 15 times the MFF for the vertical fluidized bed reactor. Table I provides the MFF in SCFH per unit bed area and the heat transfer rates for a fluid bed operating at 1800 ° F., and for a number of representative different fluidizing gas mixtures.

EXAMPLE

TABLE I

| Tyler Mesh # Dp (micron) | Parameter | 37 463 | 48 295 | 60 246 | 80 175 |
|---|---|---|---|---|---|
| N2 | MFF(NCFH/ft$^2$) | 355 | 146 | 102 | 52 |
| | 2*MFF (NCFH/ft$^2$) | 711 | 291 | 203 | 105 |
| | h (Btu/hr. ft$^2$. ° F.) | 75 | 88 | 94 | 106 |
| 100% $H_2$ gas | MFF (NCFH/ft$^2$) | 183 | 64 | 42 | 19 |
| | 2*MFF (NCFH/ft$^2$) | 365 | 127 | 83 | 38 |
| | h (Btu/hr. ft$^2$. ° F.) | 228 | 269 | 287 | 324 |
| Reformate | MFF(NCFH/ft$^2$) | 493 | 202 | 141 | 73 |
| (80%$H_2$, 20%$CO_2$) | 2*MFF (NCFH/ft$^2$) | 987 | 404 | 283 | 147 |
| | h (Btu/hr. ft$^2$. ° F.) | 187 | 220 | 235 | 266 |
| DI | MFF(NCFH/ft$^2$) | 365 | 149 | 105 | 54 |
| (40%$H_2$, 40%$N_2$ | 2*MFF (NCFH/ft$^2$) | 730 | 299 | 209 | 108 |
| 20% CO) | h (Btu/hr. ft$^2$. ° F.) | 131 | 154 | 164 | 186 |

COMPARATIVE EXAMPLE

A method of producing clean bright wire in an indirect-fired fluid bed fluidized with nitrogen gas was conducted. With 48 Tyler mesh particles at twice the MFF (2*MFF), the heat transfer coefficient is 88 Btu/hr.ft$^2$. Using DI gas, the heat transfer coefficient is 154 (Btu/hr.ft$^2$.° F.)

ECONOMIC COMPARATIVE EXAMPLE

Oil-tempered spring wire was produced using the invention of this invention. Using twelve strands of 0.375" wires at a passing rate of 18 ft/min, the wires was preheated to 1350 ° F. using induction heat and the wires were raised to the annealing temperature of 1600° F. in the fluidized bed. The fluidizing particles are alumina at 48 Tyler mesh. The gas flow rate was twice the minimum fluidizing flow.

On the basis of the consumable cost for three of the gas mixtures, calculations were made by determining the cost of the DI gas as $0.12/CCF, the nitrogen gas as $0.25/CCF, the hydrogen gas as $0.60/CCF, and the natural gas as $0.30/CCF.

Table II shows the comparison in the operating cost of the various fluidizing gases used in this invention.

TABLE II

| | 100% $N_2$ | 100% $H_2$ | Reformate (80% $H_2$) | DI (40% $H_2$) |
|---|---|---|---|---|
| h(Btu/hr. ft$^2$. ° F.) | 88 | 269 | 220 | 154 |
| Req. Flow (NCFH) | 17,299 | 11,781 | 8,251 | 10,171 |
| Operating Cost ($/hr) | 49.34 | 70.69 | — | 12.21 |

It can be seen that there is significant operating cost reduction when comparing the DI gas with the 100% N2 case of the prior art. Capital costs for the DI-fluidized bed are also significantly lower since the bed size is smaller and have less complicated construction since no firing tubes or electrical heaters are needed.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A method for annealing strand wires in a fluidized bed reactor having an atmosphere of fluidizing gases containing a high hydrogen content said fluidizing gases flowing through fluidized particles comprising:

a. stratifying the atmosphere of fluidized gases by passing a reducing gas through the fluidized particles in the fluidized bed;

b. passing the wires between the fluidized particles at a location near the bottom of the fluidized bed thereby causing the fluidized particles to circulate around said wires; and c. injecting an amount of oxygen-containing gas on top of said fluidized bed reactor.

2. The method of claim 1 wherein the reducing gas is a product of partial oxidation that comprises at least one of hydrogen and carbon monoxide.

3. The method of claim 1 wherein the reducing gas is a product of partial oxidation produced by the combustion of a mixture of air and natural gas.

4. The method of claim 3 wherein the mixture of air to natural gas is in a ratio of about 1.8:1 to about 3:1.

5. The method of claim 4 wherein the mixture of air to natural gas is in a ratio of about 2.4 to 1.

6. The method of claim 1 wherein said fluidizing particles comprise alumina.

7. The method of claim 1 wherein the size of the fluidizing particles is from about 70 to about 465 micron (Tyler mesh 200 to 37).

8. The method of claim 7 wherein the size of the fluidizing particles is from about 175 to about 295 micron (Tyler mesh 80 to 48).

9. The method of claim 1 comprising passing the wires within about one foot from the bottom of the fluidized bed.

10. The method of claim 1 wherein said oxygen-containing gas is air.

11. The method of claim 1 wherein the fluidizing gas flow is between 2 to 15 times the minimum fluidizing flow.

12. The method of claim 1 wherein said fluidizing gases comprising a hydrogen gas content of over 40 percent.

13. A method for annealing wire, sheet or strip in a fluidized bed reactor having an atmosphere of fluidizing gases containing a high hydrogen gas content said fluidizing gases flowing through fluidizing particles comprising:

a. passing an effective amount of reducing gas, through the fluidizing particles to separate an elutriated fraction of the fluidizing particles out of said fluidized bed;

b. passing a portion of a wire, sheet or strip vertically through said fluidized bed thereby causing the elutriated fraction of the fluidized particles to circulate around said portion of wire, sheet or strip;

C. injecting an amount of oxygen-containing gas through the top of said fluidized bed reactor; and d. separating said elutriated fraction of fluidizing particles from the reducing gases and returning the elutriated fraction of fluidizing particles back to the bottom of the bed.

14. The method of claim 13 wherein the reducing gas is a product of partial oxidation that comprises at least one of hydrogen and carbon monoxide.

15. The method of claim 13 wherein the reducing gas is a product of partial oxidation produced by the combustion of a mixture of air and natural gas.

16. The method of claim 15 wherein the mixture of air to natural gas is in a ratio of about 1.8:1 to about 3:1.

17. The method of claim 13 wherein said fluidizing particles comprise alumina.

18. The method of claim 13 wherein the size of the fluidizing particles is from about 70 to about 465 micron (Tyler mesh 200 to 37).

19. The method of claim 13 wherein said fluidizing gases comprising a hydrogen gas content of over 40 percent.

* * * * *